United States Patent [19]

Rasco

[11] 4,089,110

[45] May 16, 1978

[54] SHAVING MEANS

[76] Inventor: Darius K. Rasco, Rte. 5, Box 244, Mobile, Ala. 36608

[21] Appl. No.: 665,130

[22] Filed: Mar. 8, 1976

[51] Int. Cl.[2] ..... B26B 19/44; B26B 19/16

[52] U.S. Cl. ..... 30/41.5; 30/41.6; 30/43.6

[58] Field of Search ..... 30/41.5, 133, 43.4–43.6, 30/41, 41.6, 74

[56] References Cited

U.S. PATENT DOCUMENTS

| | | | |
|---|---|---|---|
| 2,109,507 | 3/1938 | Salz | 30/74 X |
| 2,388,324 | 11/1945 | Holcomb | 30/41.5 |
| 2,716,278 | 8/1955 | Thompson | 30/41.6 |
| 2,802,260 | 8/1957 | Allen | 30/41.5 |
| 2,946,123 | 7/1960 | Bray | 30/133 X |
| 2,965,966 | 12/1960 | Jacobs | 30/43.5 |
| 2,977,677 | 4/1961 | Tice | 30/41 X |
| 3,079,684 | 3/1963 | Hertzberg | 30/41 X |
| 3,103,069 | 9/1963 | Gary | 30/133 |
| 3,128,549 | 4/1964 | Hubbart | 30/41.5 |
| 3,364,568 | 1/1968 | Lowy | 30/41.5 X |
| 3,611,566 | 10/1971 | Brennan | 30/41.5 |

*Primary Examiner*—Gary L. Smith

[57] ABSTRACT

A Dry Shaver with (a) grill cooling (b) skin and whisker attracting (c) skin cooling and (d) self cleaning means; said shaver embodying a rotary fan wheel so that:

(a) air is drawn through a protector grill of a shaving head thereby cooling same (b) skin is drawn to the grill and whiskers into grill by said fan (c) air is expelled through perforations directed toward the area of the skin being shaved, said air being useful in cooling and tauting skin and (d) cut whiskers are blown into a storage chamber embodied in the shaver so that the shaver heads stay clean. The storage chamber is also self cleaning by opening the flap thereof over a trash receptacle and switching the shaver on momentarily which blows the cut whiskers out of the storge chamber and into the receptacle.

12 Claims, 17 Drawing Figures

FIG. 15 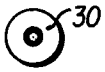
FIG. 14 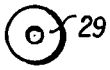
FIG. 13 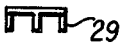
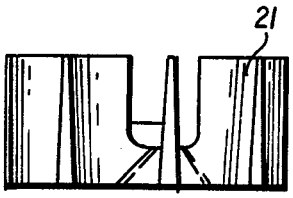
FIG. 11
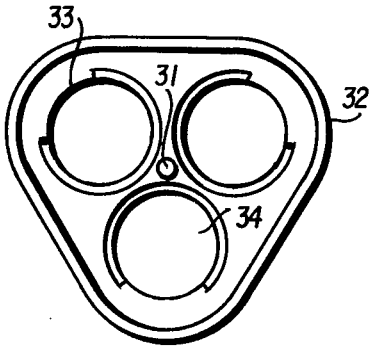
FIG. 12
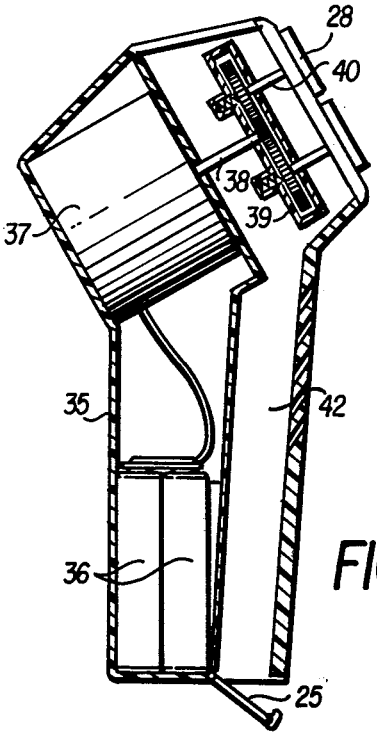
FIG. 16
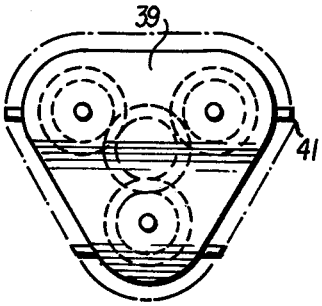
FIG. 17

SHAVING MEANS

SUMMARY OF THE INVENTION

The invention comprises a shaver embodying air agitation and conduction facilities whereby air is drawn in through one or more heads of the shaver and expelled through perforations in the housing of the shaver. The air is directed toward the area of skin being shaved. The shaver also embodies facilities for scraping the inside periphery of protector grills and has a self cleaning storage chamber for cut whiskers.

An object of the invention is to provide a shaver with a rotary fan blade wheel or the like that will draw air in through a protector grill or grills thus keeping the grills cool for a more comfortable shave.

Another object is to draw the skin closer to the grill and to draw the whiskers further into the grill for a closer and a more uniformly smooth shave.

Another object is to expell air through perforations in front of the shaver in a direction toward the area of skin being shaved so as to further cool the skin for greater comfort and to tauten the skin for an even closer shave than would otherwise be possible.

Another object is to provide self cleaning of the heads by drawing cut whiskers away from the heads and blowing whiskers into the self cleaning storage chamber.

Another object is to provide means for rotation of the grills when not in contact with the skin and provide a disk with legs which scrape the inside periphery of the grill wall as the grills rotate to further enhance self cleaning of the shaving heads and thus prevent clog up of whiskers that might otherwise result.

BRIEF DESCRIPTION OF THE DRAWINGS

The foregoing and other objects of the invention are more fully described in the following discription and accompanying drawings wherein:

FIG. 12 is an inside plan view of a head assembly with the bottom lip of a grill hole having a portion thereof (as represented by a broken line) covered by a partial upper lip. The lip of the grill fits between the lower lip and the partial upper lip of the grill hole thus defining the degree of flotation possible for the grills.

FIG. 13 is a side elevation and FIG. 14 a top plan view of a disk with a plurality of equally spaced legs around the periphery thereof, said disk fitting over a short stud in the center of the head assembly with one leg fitting into the inside of each grill with legs being somewhat shorter than the depth of the grill to allow necessary flotation thereof. The purpose of the legs is to scrape off the whisker stubble from the wall of the rotating grill.

FIG. 15 is a plan view of a thin disk shaped nut which holds disk 29 in place.

FIG. 16 is a side elevation of another version of the invention and

FIG. 17 is a plan view of the top front of the shaver of FIG. 16.

DETAILED DESCRIPTION OF THE PREFERRED EMBODIMENTS

While the detailed description includes several versions of the invention it will be understood and appreciated by those skilled in the art that many other variations are possible without departing from the intended scope of the present invention.

Figure 1:
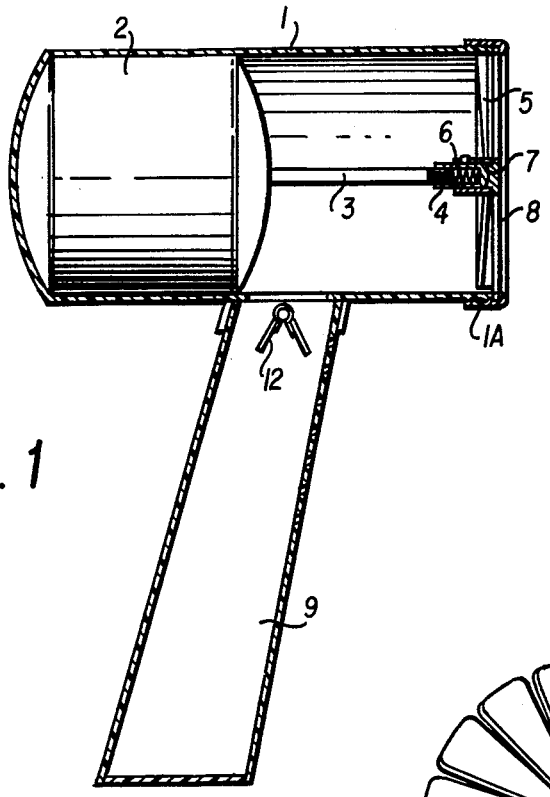
FIG. 1 is a section of the side view of a first embodiment of a shaver comprising the present invention.

FIG. 1 depicts a slanted tee shaped shaver housing 1, of molded plastic, having a motor 2 which operates a rotary shaft 3 projecting from the motor with the forward end of the shaft 3 being connected via matching grooves and ridges to the spring containing inner hub 4. An outer hub 4A (which extends an equal distance on either side of fan wheel 5) is secured to the inner hub 4 by a set screw and the outer hub 4A is spot welded to the fan wheel 5. The forward portion of inner hub 4 has an oval convexity which is urged by springs 6 into contact with oval concavity 7 which is welded to the inside center of protector grill 8. Grill 8 is held to the shaver housing by a retaining ring screwed on to threads 1A that are self contained on housing 1.

Figure 2:
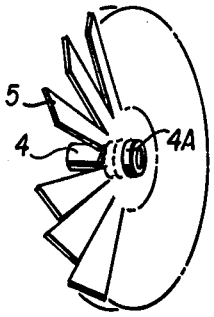
FIG. 2 is a perspective view of a combination cutting (or shaving) and fan wheel.
Figure 3:
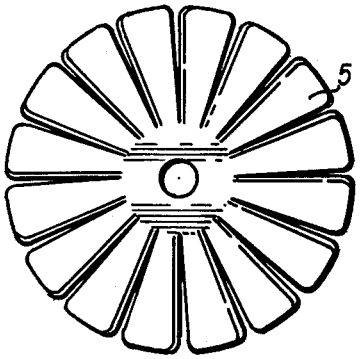
FIG. 3 is a plan view of the combined whisker cutting and fan wheel.
Figure 4:
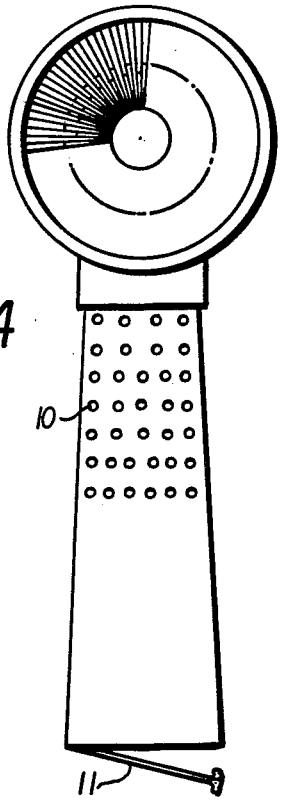
FIG. 4 is a front elevation of the shaver shown in FIG. 1. Note: Instead of using the fan wheel shown in FIGS. 2 and 3 as a cutting or shaving wheel, a more conventional head assembly can be used and the fan wheel can be secured further back on a shaft used to operate a gear assembly.
Figure 5:
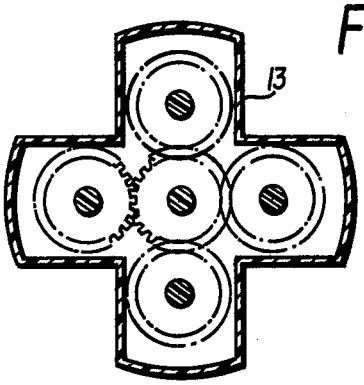
FIG. 5 is a plan view of a gear assembly which operates more conventional multi-shaving head assembly.

FIG. 2 depicts a combination whisker cutting and fan wheel 5 which comprises a disk shaped body with a plurality of fan like blades radiating from a central axis. The blades having a beveled cutting surface along the edge of each blade with one edge of each blade beveled in one direction and the other edge beveled in the opposite direction so that either side of wheel 5 is identical and can face toward the inside of protector grill 8 for cutting whiskers and/or for:

(a) drawing air in through grill 8 of the shaver to maintain coolness thereof for a more comfortable shave.

(b) drawing the skin to the grill and the whiskers into the grill for a closer and more uniformly smooth shave.

(c) Self cleaning of shaver head by conducting or blowing cut whiskers away from the head and into a whisker storage chamber 9.

(d) Expelling air for cooling the skin through perforations 10 located in front of storage chamber outer wall at an angle which directs air toward the area of skin being shaved.

(e) Flushing out the whisker storage chamber after opening the bottom flap 11 thereof over a waste receptacle and switching shaver on momentarily.

The anti-regurgitation hinge 12 is circular in shape with its hinge action extended diameterically therethrough. The hinge is held partially open by gravity when the shaver is upright and by air pressure when the shaver is operating in any position. Wider opening of hinge is prevented by a rigid member extending over the hinge pin and under each hinge flap. The hinge pin holds the two halves of circular hinge 12 together and extends into the wall of the shaver housing to hold the hinge in place. Automatic closing of hinge 12 occurs when the shaver is held bottom up and thus prevents accidental return of cut whiskers from storage compartment 9 to the compartment containing the shaving heads. The hinge is closed automatically by gravity when the shaver is held bottom up. The rigid member is depicted by a short line under each flap of hinge 12 as shown in the side view of FIG. 1. By extending over the hinge pin and under each flap, the rigidity of the member prevents any further opening. By opening, it is meant that the flaps are lowered to increase the opening between the compartments during normal operation of the shaver and, conversely, raising the flaps (as is done automatically when the shaver is held bottom up) decreases or closes the opening between compartments.

Note: Instead of using fan wheel 5 as a whisker cutting or shaving wheel, a more conventional shaving head assembly 14 can be used and fan wheel 5 secured further back on shaft 3 with the forward end of the shaft connected to the center gear in the plastic encased gear assembly 13. Gear assembly 13 has a plurality of shafts extending on to and connected with head assembly 14 which is held to shaver housing by a retaining ring. This version would also perform all of the functions outlined in the foregoing sub-paragraphs (a) through (e).

The back or bottom half of the plastic encasement for gear assembly 13 has a pluraity of cylindrical hollow spaces 15 provided for springs 16 which urge forward disk 17 which separates spring 16 from shaft 18 the rear end of said shaft 18 being somewhat larger than the shaft hole in the upper or forward part of the plastic encasement.

Figure 8:
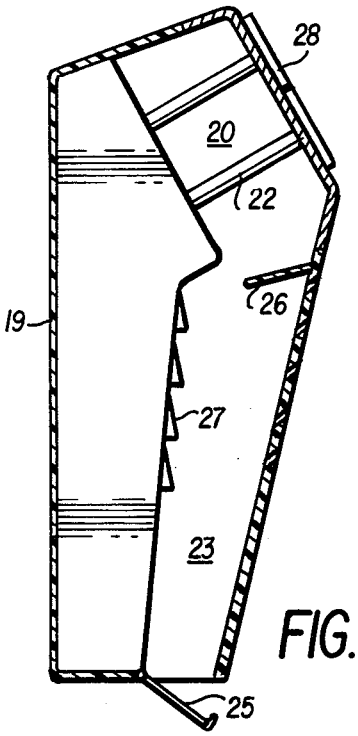
FIG. 8 is a side view of a more conventional version of the shaver comprising the present invention.
Figure 9:
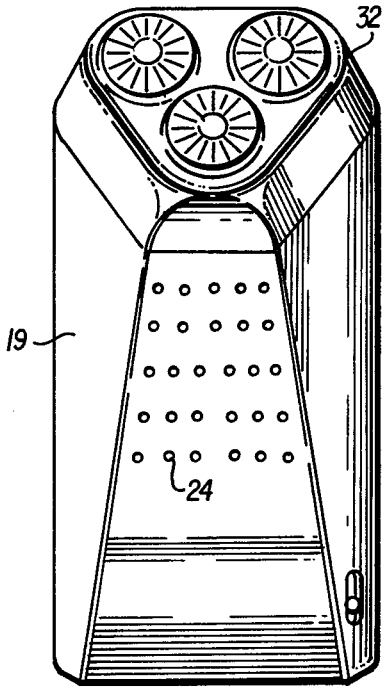
FIG. 9 is a top and front elevation view of same.

The version of shaver 19 shown in FIGS. 8 and 9 is somewhat like the Sears "ROTOMATIC" with an enlarged compartment 20 provided between the head gear assemblies so that fan wheel 5 or 21 or the like can be installed on forward shaft 22. The size of the wheel is such that the outer periphery of the wheel blades extend almost to the other shafts and well under the heads operated by said shafts so that the fan wheel 5 or 21 draws air in through protecter grills 28 of the shaver heads, cooling same and attracting skin and whiskers thereto, with cut whiskers being blown into whisker storage chamber 23 and air thence expelled and sprayed on the skin through perforations 24. Self cleaning of the storage chamber is accomplished by opening the flap 25 over a waste receptacle and switching the shaver on momentarily. Holding the hand over perforations 24 when the flap is open increases the air pressure for flushing out the whisker storage chamber 23.

Figure 6:
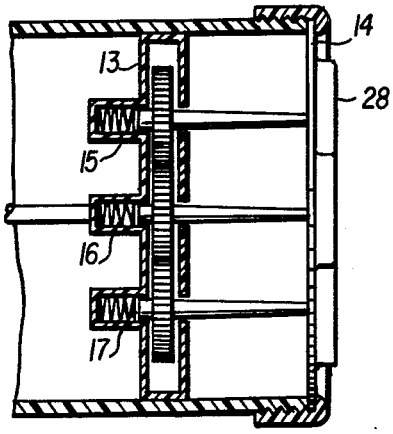
FIG. 6 is a side view and FIG. 7 a front plan view of a shaving head assembly.
Figure 7:
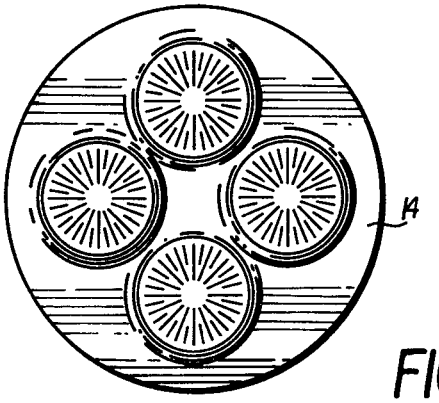
Figure 10:
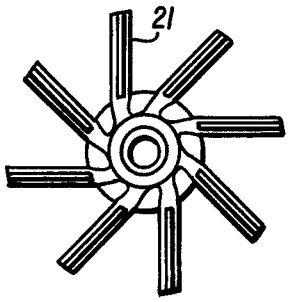
FIG. 10 is a plan view and FIG. 11 a side elevation of an alternate type fan wheel.

While the fan wheel 5 or 21 are usable in the FIG. 6 or FIG. 8 versions, the preferred fan wheel for the FIG. 8 version is fan wheel 5. FIG. 10 is a top view of wheel 21 with the blades of the wheel extending from the hub at an off center angle. FIG. 11 is an elevation view of the wheel showing the bottom part of the blades extending from the hub a short distance and then curved upward where the height of the blade is quadrupled from there on to the periphery. The thickness of the blades becomes somewhat narrower from base to top and from periphery toward center. The hub of wheel 21 projects above the portion of the hub to which the bottom parts of the blades are attached. A set screw (not shown) is provided in the extended portion of the hub so that wheel 21 may be secured to a rotatable shaft 22. Fan wheels can be made of plastic, fiber glass or other suitable material in the FIGS. 6 and 8 version.

The anti-regurgitation facilities in the FIG. 8 version consist of a semi-lid 26 which extends at an angle from side to side across the top front of the whisker storage chamber 23 and projections 27 across the back wall of the storage chamber. The lid 26 and projections 27 also help to guide air out thru perforations 24 which are slanted through the forward wall of the storage chamber 23 in a direction toward the area of skin being shaved.

The self cleaning aspects of the inside of grills 28 is enhanced in the FIG. 8 version by eliminating the plurality of plastic rings and eliminating the thin flat metal retaining piece that is triangular in shape with a plurality of holes that ordinarily hold plastic rings, cutter wheels and grills together and also prevents the grills from rotating. The plastic rings usually restrain the grills from turning because they fit tightly within the insides of the grills. The plastic rings themselves are held by a spur like projection inside each hole of a thin flat retaining piece, this spur fitting being between the vertical toothed gear-like exterior of the rear half of plastic rings as on the Sears "Rotomatic". Thus, with rings removed, the grills rotate very slowly (between 1 to 10 RPM) in response to friction with the rotating cutters. The speed of the grills is increased slightly by magnetic attraction between the cutter and grill; however, pressing the grills to the skin for shaving stops the rotation of the grills in either case which is desirable because rotating the grills against the skin would cause skin burn and irritation.

Thus by eliminating these rings, the grills 28 rotate when not in contact with the skin. The disk 29, with one leg fitting against the inside wall of the periphery of each grill 28, scrapes the walls very slightly as the grills rotate. This prevents clogging of cut whiskers in the shaver head that might otherwise occur. The scraper legs are stationary; however, the scraping of the grills by the legs occurs as the grills rotate against the legs and cut whiskers which otherwise build up (beginning usually on the inside periphery of the grills) and are thus scraped off to break up or prevent such build up. Cut whiskers are drawn from under shaving heads and blown into the storage chamber in any event.

The center of scraper 29 fits over a short stud 31 in the center of the under side of the shaver head assembly 32 with the top of a disk shaped holding nut 30 being flush with the top of stud 31 when assembled and the bottom of nut 30, a portion of which extends slightly over the edge of grill holes 34 (in head assembly 32) being flush with the bottom of the partial upper lip 33, (and if optional scraper 29 were omitted;) nut 30 and lip 33 retain grill 28 in assembly 32.

To hold cutter wheel and grill 28 together in the FIG. 8 version, the rim of the hub on the inside center of grill 28 is magnetized which provides an attraction strong enough to hold the light weight cutter wheel but not strong enough to interfere with the rotation of the wheels as required in normal operation. Referring to FIG. 9, the magnetized inside center of the grill is shown by reference numeral 28 showing apertures which radiate from the central magnetic hub. Although the hubs are not shown in FIGS. 6, 8, and 16, they are applicable thereto as in the Sears "Rotomatic" grill. The hub may be made of iron or steel that has been magnetized, magnetite loadstone, plastic or other material impregnated with magnetic particles and cutter wheels made of other magnetizable metals.

While the detailed descriptions of the FIGS. 1, 6, 8 and 16 versions may in some instances specify the type material of which shaver or related parts are made, this does not exclude construction from any material suitable for the intended use.

Another version of this invention is depicted in FIG. 16 comprises a housing 35 of molded plastic, a power source 36, a motor 37, a rotating shaft 38 projecting from the motor, a fan wheel (previously described) as wide as housing space permits, mounted to shaft 38 with the forward end of the shaft connecting via matching ridges and notches to the center gear in a tri-angular shaped plastic encased gear assembly 39. Gear assembly 39 is glued to partitions 41 that protrude from the housing, the gear assembly serving to operate a plurality of rotating shafts 40 projecting from the gear assembly which operate the head assembly 32 (previously described with optional grill scraping means) comprising a triangular shaped body of stainless metal 32 with a hole 34 for each grill 28. The holes, looking from the under side of the head assembly, are larger at the top with a lip around the periphery in the bottom of the hole and a partial upper lip, as represented by broken line 33. The space between the lips define the degree of flotation possible for grills 28 which fit into holes with the lips of the grills 28 fitting between the lips of hole 34 with disk 29 fitting over short stud 31 and being held in place by thin disk shaped nut 30 so that when the head is assembled one leg of disk fits against the peripheral wall on the inside of grill 28. The legs of disc 29 rub against the inside walls of grills 28 to scrape off the shavings thereby preventing their buildup.

The hub on the inside center of grill 28 is magnetized to hold the light weight cutter wheel in place but is not strong enough to interfere with the rotation of wheels as required in normal operation. Rotation of the wheels tends to rotate grills 28 at a slower speed with the inside walls of the peripheries of grills 28 barely scraping against the legs of disk 29 as the grills rotate thus preventing clogging of whisker stubble that might otherwise occur.

As motor 37 is operated, the fan wheel 21 draws air in thru grills 28 to effect cooling of the grills for a more comfortable shave and draws skin to the grills and whiskers into the grills for a closer and more uniformaly clean shave. The fan wheel 21 also draws cut whiskers from under the shaving heads and blows them into the previously described self cleaning whisker storage chamber 42 with air being expelled through perforations 24 toward the area of skin being shaved.

On non-rotary shavers the fan wheel would be connected to a motor shaft between the motor and an oscillating transmission.

Dry shavers without a motorized rotating shaft could be equipped with a small motor for providing grill cooling, skin attracting and self cleaning means.

Having thus disclosed in detail my invention and having described the prefered mode of carrying out my novel process, I claim as new and desire to secure by letters patent:

1. A power shaver for shaving whiskers from the skin comprising a housing having first and second compartments therein, said second compartment being used for whisker storage and having a plurality of apertures in the forward wall thereof directed during operation of said shaver toward the skin being shaved, motor means located within said first compartment, the shaft of said motor means projecting through the wall of said first compartment, a shaving head attached to said housing including a face plate having at least one opening therein and at least one rotatable cutter blade positioned adjacent the inside surface of said face plate at said opening, said head being connected to said second compartment, a gear assembly coupled to the shaft of said motor means and interposed between the forward wall of the first compartment of said housing and the cutter blade of said shaving head, said motor means rotating said cutter blade relative to said face plate for cutting said whiskers, a fan secured to the shaft of said motor means for drawing air in through the opening in said face plate, into said second compartment for whisker storage and out through the plurality of apertures in the forward wall of said compartment to direct the expelled air against the skin being shaved, said fan further drawing the whiskers cut by said cutter blade into said second compartment for storage therein, a releasable cover in the wall of said second compartment to permit removal of said whiskers, said second compartment being air flushable by operation of said fan with said cover removed thereby expediting removal of whiskers from within said second compartment.

2. A power shaver as defined by claim 1 which further comprises anti-regurgitation means mounted within said second compartment for directing whiskers into said storage compartment from said shaving head when said shaver is in the operating position and confining the whiskers within said storage compartment when said shaver is not in said operating position.

3. A power shaver as defined by claim 2 wherein said anti-regurgitation means comprises a hinge pivotally mounted within said second compartment adjacent said shaving head.

4. A power shaver as defined by claim 2 wherein said anti-regurgitation means comprises a first member projecting within said second compartment from the forward wall thereof between the plurality of apertures in said forward wall and said shaving head and a plurality of second members projecting within said second compartment from the wall thereof opposite said forward wall.

5. A power shaver as defined by claim 1 wherein said shaving head comprises a plurality of rotatable cutter blades; and said gear assembly comprises a plurality of driven gears each having a spring-loaded blade-driving shaft for driving a respective one of said cutter blades, and a drive gear coupled to the shaft of said motor means for drivingly engaging said plurality of driven gears.

6. A power shaver as defined by claim 5 wherein said face plate has a plurality of openings each having a lip around the inside periphery of the forward-most part and a partial lip on the rear-most part thereof, said face plate further having a stud at the rear center thereof; said power shaver further comprising a plurality of removable apertured protector grills, each of said grills having a lip around the outer periphery thererof, the lip of each grill fitting between the lips of the respective openings in said face plate; and said cutter blades fit within said respective grills; said power shaver further comprising a disk-shaped nut affixed to said stud with the edge of said nut extending over the rear edge of said grills with the underside of said nut flush with the forward side of the partial lips of said openings to retain said grills in said openings.

7. A power shaver as defined by claim 1 wherein said cutter blade and said fan are combined into a single fan and whisker cutting wheel, said wheel comprising a disk-shaped body having a plurality of fan-like blades radiating from a central axis, each of said blades having a beveled cutting surface along its edges with one edge being beveled in one direction and the other edge being beveled in the opposite direction, whereby either side of said wheel can face toward the inside surface of said face plate.

8. A power shaver as defined by claim 1 wherein the plurality of apertures in said forward wall are slanted in an upward direction so that the expelled air will be directed against the skin being shaved.

9. A power shaver for shaving whiskers from the skin comprising a housing, motor means having a rotary shaft located within said housing, a shaving head attached to said housing, said shaving head including a face plate having a plurality of openings therein, a plurality of removable apertured protector grills rotatable with respect to said face plate, a scraper member fixedly mounted on said face plate so as to scrape against said rotatable protector grills to minimize clogging of cut whiskers within said shaving head, and a plurality of rotatable cutter wheels positioned adjacent the inside surface of said face plate, and a gear assembly coupled to the rotary shaft of said motor means and to the cutter wheels of said shaving head, said gear assembly comprising a plurality of driven gears each having a spring-loaded blade-driving shaft for driving a respective one of said cutter wheels, and a drive gear coupled to the shaft of said motor means for drivingly engaging said plurality of driven gears.

10. A power shaver as defined by claim 9 wherein said rotatable grills rotate when said face plate is not pressed against the skin.

11. A power shaver as defined by claim 9 wherein said face plate has a plurality of openings each having a lip around the inside periphery of the forward most part and a partial lip in the rear-most part thereof, said face plate further having a stud at the rear center thereof; and wherein each of said grills has a lip around the outer periphery thereof, the lip of each grill fitting between the lips of the respective opening in said face plate; and said cutter wheels fit within said respective grills; said power shaver further comprising a disc-shaped nut affixed to said stud with the edge of said nut extending over the rear edge of said grills with the under side of said nut flush with the forward side of the partial lips of said openings to retain said grills in said openings.

12. A power shaver as defined by claim 11 wherein each of said grills is provided with a magnetized hub for holding the respective cutter wheel in place.

* * * * *